US009427979B2

(12) United States Patent
Takenaka et al.

(10) Patent No.: US 9,427,979 B2
(45) Date of Patent: Aug. 30, 2016

(54) INKJET RECORDING APPARATUS THAT CONVEYS RECORDING MEDIUM WHILE APPLYING NEGATIVE PRESSURE

(71) Applicant: KYOCERA Document Solutions Inc., Osaka (JP)

(72) Inventors: Hidenori Takenaka, Osaka (JP); Takeshi Watanabe, Osaka (JP); Jumpei Hobo, Osaka (JP); Tomohisa Soda, Osaka (JP); Shinji Yoshinaga, Osaka (JP); Hiroatsu Tamai, Osaka (JP); Satoshi Tsunemi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/956,654

(22) Filed: Dec. 2, 2015

(65) Prior Publication Data

US 2016/0159114 A1 Jun. 9, 2016

(30) Foreign Application Priority Data

Dec. 3, 2014 (JP) ..... 2014-244664

(51) Int. Cl.
*B41J 11/00* (2006.01)

(52) U.S. Cl.
CPC ..... *B41J 11/0085* (2013.01)

(58) Field of Classification Search
None
See application file for complete search history.

(56) References Cited

U.S. PATENT DOCUMENTS

2009/0244242 A1* 10/2009 Sawada ..... B41J 11/0085 347/104
2009/0244247 A1* 10/2009 Yamamoto ..... B41J 11/007 347/104
2010/0117293 A1* 5/2010 Shinohara ..... B41J 11/0005 271/264
2011/0234675 A1* 9/2011 Korogi ..... B41J 11/0095 347/16
2013/0162742 A1* 6/2013 Inoue ..... B41J 13/22 347/104

FOREIGN PATENT DOCUMENTS

JP 2008-213255 A 9/2008

* cited by examiner

*Primary Examiner* — Bradley Thies
(74) *Attorney, Agent, or Firm* — Studebaker & Brackett PC

(57) ABSTRACT

An inkjet recording apparatus includes a recording head, a conveyance section, and a negative pressure applying section. The recording head ejects ink onto a recording medium. The conveyance section conveys the recording medium placed on a conveying surface thereof to the recording head. The negative pressure applying section includes an airflow chamber and causes the recording medium to be sucked onto the conveying surface by negative pressure through holes in an upper wall of the airflow chamber and holes in the conveying surface. Negative pressure applied through first holes in a first region is greater than that applied through second holes in a second region. The first region is located upstream of a head facing region in a conveyance direction of the recording medium. The second region is located downstream of the first region in the conveyance direction of the recording medium and includes the head facing region.

14 Claims, 10 Drawing Sheets

INKJET RECORDING APPARATUS THAT CONVEYS RECORDING MEDIUM WHILE APPLYING NEGATIVE PRESSURE

INCORPORATION BY REFERENCE

The present application claims priority under 35 U.S.C. §119 to Japanese Patent Application No. 2014-244664, filed on Dec. 3, 2014. The contents of this application are incorporated herein by reference in their entirety.

BACKGROUND

The present disclosure relates to inkjet recording apparatuses.

An inkjet apparatus that ejects ink onto a recording medium may address a problem of nozzle clogging in a recording head by adopting a known paper dust removal technique.

An inkjet recording apparatus of one known example is provided with a paper dust collector located upstream of a recording head in a conveyance direction of a recording medium. The paper dust collector has a vertical wall and a downstream wall. The vertical wall stands vertically upward. The downstream wall extends from the top end of the vertical wall in a downstream direction in the conveyance direction of the recording medium.

The paper dust collector collects paper dust generated during conveyance of the recording medium before the paper dust reaches the recording head. This can reduce subsequent attachment of paper dust to the recording head.

SUMMARY

An inkjet recording apparatus according to the present disclosure includes a recording head, a conveyance section, and a negative pressure applying section. The recording head ejects ink onto the recording medium. The conveyance section has a conveying surface on which the recording medium is to be placed, and conveys a recording medium while the recording medium is placed on the conveying surface. The conveying surface has a plurality of holes. The negative pressure applying section includes an airflow chamber that has an upper wall having a plurality of holes and in which negative pressure for the recording medium is created. The negative pressure applying section sucks the recording medium by the negative pressure through the holes in the upper wall and the holes in the conveying surface to cause the recording medium to be sucked on the conveying surface. Negative pressure applied through a plurality of first holes among the holes in the upper wall is greater than negative pressure applied through a plurality of second holes among the holes in the upper wall. The first holes are located in a first region of the upper wall. The second holes are located in a second region of the upper wall. The first region is located upstream of a head facing region of the upper wall in a conveyance direction of the recording medium. The head facing region is located opposite to the recording head with the conveying surface therebetween. The second region is located downstream of the first region in the conveyance direction of the recording medium and includes the head facing region.

DETAILED DESCRIPTION

Figure 1:
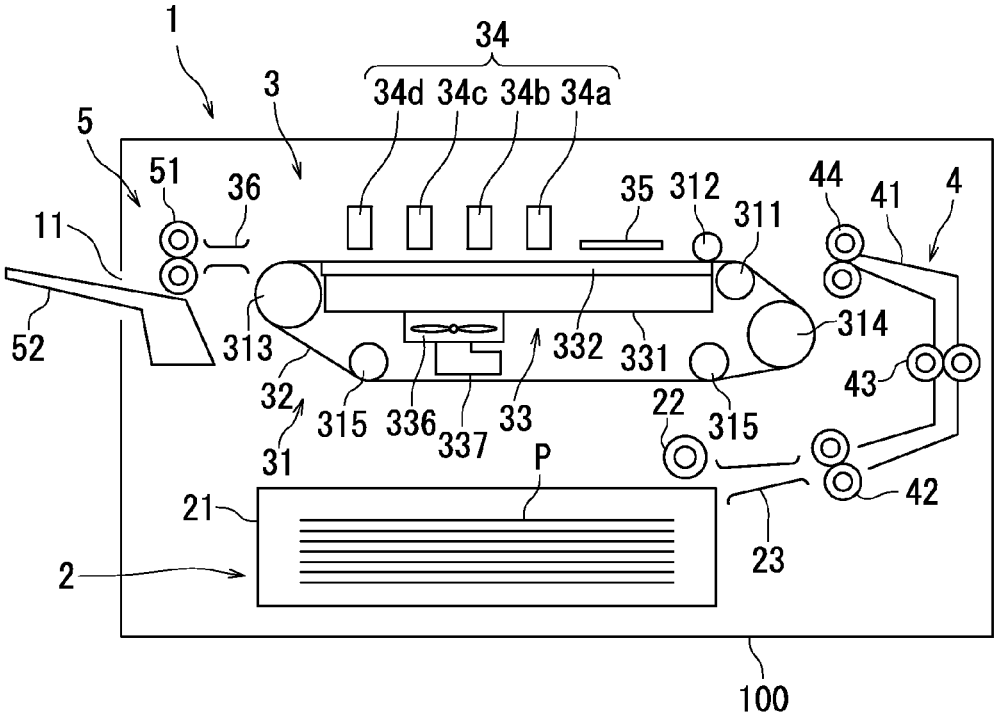
FIG. 1 illustrates structure of an inkjet recording apparatus according to an embodiment.

The following describes an embodiment of the present disclosure with reference to the accompanying drawings. In the drawings, the like reference numerals represent similar components and explanation thereof is not repeated.

First, an inkjet recording apparatus 1 according to the present embodiment will be described with reference to FIG. 1. FIG. 1 illustrates structure of the inkjet recording apparatus 1 according to the present embodiment. The inkjet recording apparatus 1 includes an apparatus housing 100, a sheet feed section 2, an image forming section 3, a sheet conveyance section 4, and a sheet ejecting section 5. The sheet feed section 2 is disposed in a lower part of the apparatus housing 100. The image forming section 3 is disposed above the sheet feed section 2. The sheet conveyance section 4 is disposed at a side of the image forming section 3 (right side in FIG. 1). The sheet ejecting section 5 is disposed at the other side of the image forming section 3 (left side in FIG. 1).

The sheet feed section 2 includes a sheet feed cassette 21, a sheet feed roller 22, and a guide plate 23. The sheet feed cassette 21 is for storing recording sheets P and is attachable to and detachable from the apparatus housing 100. The sheet feed roller 22 is located above one end of the sheet feed cassette 21 (right end in FIG. 1). The guide plate 23 extends between the sheet feed roller 22 and the sheet conveyance section 4.

The sheet feed cassette 21 is loaded with a plurality of recording sheets P. In the following description, a recording sheet P is referred to simply as a "sheet" for the sake of convenience. A sheet P is an example of a "recording medium". The sheet feed roller (pickup roller) 22 feeds sheets P one at a time in the conveyance direction of the sheet P by picking up the uppermost sheet P stored in the sheet feed cassette 21. The guide plate 23 guides the sheet P picked up by the sheet feed roller 22 to the sheet conveyance section 4.

The sheet conveyance section 4 includes a sheet conveyance path 41, a pair of first conveyance rollers 42, a pair of second conveyance rollers 43, and a pair of registration rollers 44. The sheet conveyance path 41 substantially defines a C-shape. The pair of first conveyance rollers 42 is located at the entry of the sheet conveyance path 41. The pair of second conveyance rollers 43 is located at an intermediate location on the sheet conveyance path 41. The pair of registration rollers 44 is located at the exit of the sheet conveyance path 41.

The pair of first conveyance rollers 42 is a pair of rollers (a pair of feed rollers) that feeds a sheet P in the conveyance direction of the sheet P. The sheet P fed from the sheet feed section 2 is caught between the first conveyance rollers 42 and forwarded to the sheet conveyance path 41. Also, the pair of second conveyance rollers 43 is a pair of feed rollers. The sheet P forwarded from the pair of first conveyance rollers 42 is caught between the pair of second conveyance rollers 43 and forwarded toward the pair of registration rollers 44.

The pair of registration rollers 44 performs skew correction on the sheet P having been conveyed by the second conveyance rollers 43. The pair of registration rollers 44 temporarily holds the sheet P to synchronize the conveyance of the sheet P and image formation, and then feeds the sheet P to the image forming section 3 according to timing of the image formation.

The image forming section 3 includes a conveyor belt 32 and recording heads 34. The conveyor belt 32 conveys the sheet P fed from the pair of registration rollers 44 in a predetermined direction (leftward in FIG. 1). The recording heads 34 form an image on the sheet P being conveyed on the conveyor belt 32. Detailed structure of the image forming section 3 will be described later with reference to FIG. 2. The image forming section 3 additionally includes a conveyance guide 36 located downstream (to the left in FIG. 1) of the recording heads 34 in the conveyance direction of the sheet P.

The conveyance guide 36 guides the sheet P discharged from the conveyor belt 32 to the sheet ejecting section 5. The sheet ejecting section 5 includes a pair of ejection rollers 51 and an exit tray 52. The exit tray 52 is secured to the apparatus housing 100 so as to protrude outward from an exit port 11 formed in the apparatus housing 100.

The pair of ejection rollers 51 forwards the sheet P toward the exit port 11 after the sheet P passes through the conveyance guide 36. The exit tray 52 guides the sheet P ejected by the pair of ejection rollers 51. The sheet P is ejected out of the apparatus housing 100 by the pair of ejection rollers 51 through the exit port 11 formed in a side surface of the apparatus housing 100 (a left side surface in FIG. 1). The sheet P ejected through the exit port 11 is stacked in the exit tray 52.

Figure 2:
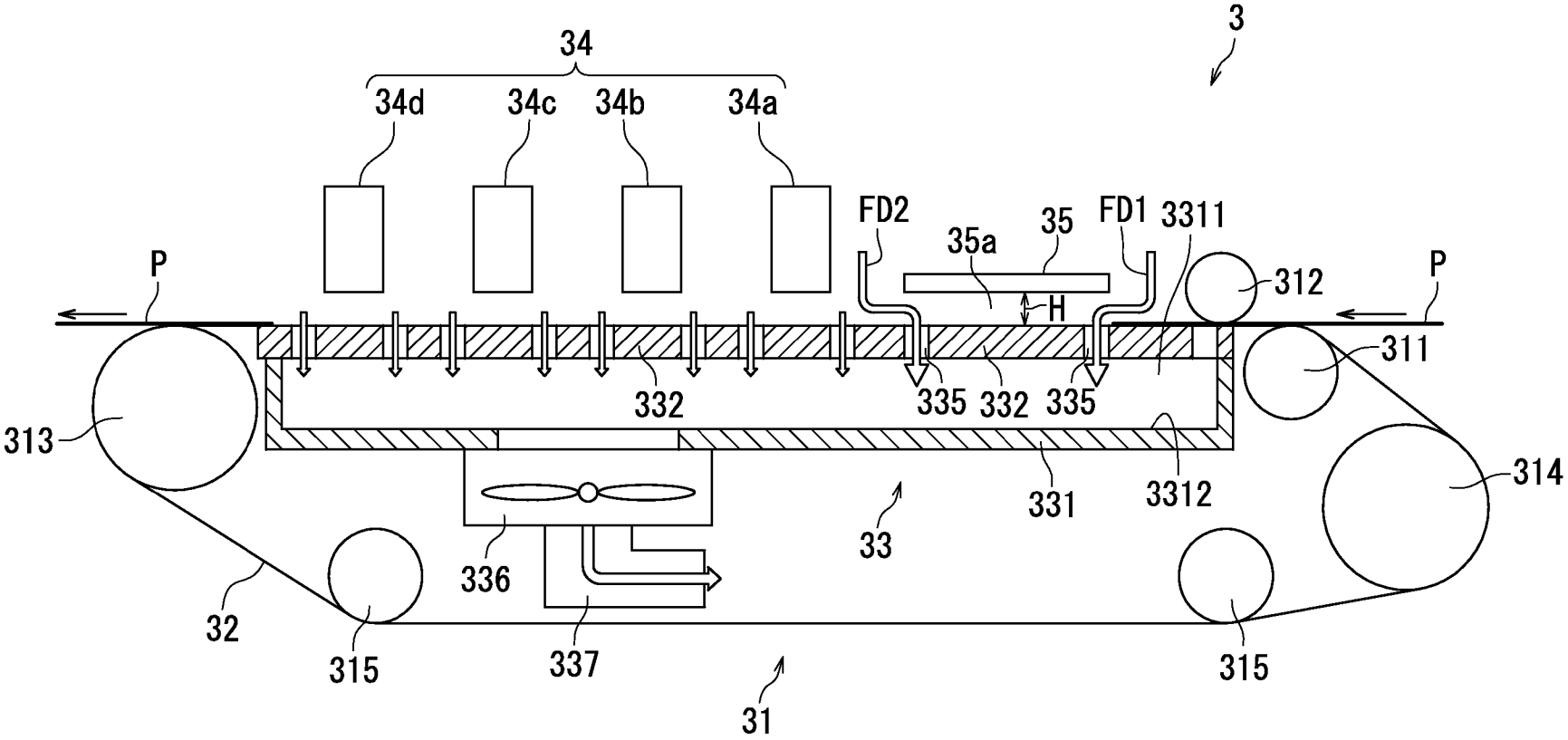
FIG. 2 illustrates structure of an image forming section illustrated in FIG. 1.

Next, a description will be given of the image forming section 3 with reference to FIG. 2. FIG. 2 illustrates structure of the image forming section 3 illustrated in FIG. 1.

As illustrated in FIG. 2, the image forming section 3 includes a conveyance section 31, a negative pressure applying section 33, the recording heads 34, and a plate member 35. The recording heads 34, which specifically are four types of recording heads 34*a*, 34*b*, 34*c*, and 34*d*, each include a plurality of nozzles (not illustrated). Ink is ejected through the plurality of nozzles so as to form images such as characters and figures on a sheet P. The recording heads 34*a*, 34*b*, 34*c*, and 34*d* are substantially identical in structure and may therefore be generally referred to as recording heads 34 without distinguishing therebetween.

The conveyance section 31 conveys a sheet P in a predetermined direction (leftward in FIG. 2) and includes a belt speed detecting roller 311, a placing roller 312, a drive roller 313, a tension roller 314, a pair of guide rollers 315, and the conveyor belt 32.

The conveyance section 31 is located opposite to the four types of recording heads 34 (34*a*, 34*b*, 34*c*, and 34*d*) in the apparatus housing 100. The conveyor belt 32 is stretched around the belt speed detecting roller 311, the drive roller 313, the tension roller 314, and the pair of guide rollers 315. The conveyor belt 32 is driven to circulate in the conveyance direction of the sheet P (counterclockwise in FIG. 2) to convey the sheet P. The conveyor belt 32 is an example of an "endless belt".

The tension roller 314 tensions the conveyor belt 32 in order to prevent sagging of the conveyor belt 32.

The belt speed detecting roller 311 is located upstream (to the right in FIG. 2) of the negative pressure applying section 33 in the conveyance direction of the sheet P and rotates by friction with the conveyor belt 32. The belt speed detecting roller 311 includes a pulse plate (not illustrated) that integrally rotates with the belt speed detecting roller 311. The circulation speed of the conveyor belt 32 is measured by measuring the rotational speed of the pulse plate.

The drive roller 313 is located downstream (to the left in FIG. 1) of the negative pressure applying section 33 in the conveyance direction of the sheet P. The drive roller 313 is preferably located in cooperating relation with the belt speed detecting roller 311 so as to ensure the flatness of the conveyor belt 32 at regions opposite to the recording heads 34.

The drive roller 313 is driven to rotate by a motor (not illustrated) to circulate the conveyor belt 32 counterclockwise in FIG. 2.

The pair of guide rollers 315 is located below the negative pressure applying section 33 to secure space below the negative pressure applying section 33. This arrangement can prevent a portion of the conveyor belt 32 below the negative pressure applying section 33 from touching the negative pressure applying section 33.

The four types of recording heads 34 (34*a*, 34*b*, 34*c*, and 34*d*) are arranged in order from upstream to downstream in the conveyance direction of the sheet P. The recording heads 34*a*, 34*b*, 34*c*, and 34*d* each include a plurality of nozzles (not illustrated) arranged in a width direction of the conveyor belt 32 (direction perpendicular to the drawing surface in FIG. 2). The recording heads 34*a*, 34*b*, 34*c*, and 34*d* are referred to as a line type recording heads. From this follows that the inkjet recording apparatus 1 is a line head inkjet recording apparatus.

The negative pressure applying section 33 applies negative pressure to the sheet P through the conveyor belt 32, causing the sheet P to be sucked onto the conveyor belt 32. The negative pressure applying section 33 is located on the rear surface (underside in FIG. 2) of the conveyor belt 32 and opposite to the four types of recording heads 34 with the conveyor belt 32 therebetween. The negative pressure applying section 33 includes an airflow chamber 331 that is open at the top, a guide member 332 that closes the open top of the airflow chamber 331, a negative pressure creating section 336, and a gas outlet 337.

The placing roller 312 is a driven roller. The placing roller 312 is located opposite to the guide member 332 with the conveyor belt 32 therebetween. The placing roller 312 guides the sheet P that has been fed from the pair of registration rollers 44 onto the conveyor belt 32 so that the sheet P is sucked onto the conveyor belt 32.

The guide member 332 supports the sheet P through the conveyor belt 32. The guide member 332 is an example of a "conveyor plate". The guide member 332 has through holes 335. The guide member 332 is formed from, for example, a metallic material. Specifically, the guide member 332 may be made from die-cast aluminum or a pressed metal plate. Alternatively, the guide member 332 may be made from resin to provide excellent slidability of the guide member 332 against the conveyor belt 32. Note that although grooves 334 (see FIGS. 3 and 4) are not illustrated in FIG. 2, the through holes 335 pass through the guide member 332 from a bottom surface of a corresponding one of the grooves 334 located in the upper surface of the guide member 332.

For the sake of convenience, the present embodiment describes the guide member 332 as part of the negative pressure applying section 33. Alternatively, however, the guide member 332 may be described as part of the conveyance section 31 because the guide member 332 supports the conveyor belt 32 as described above.

The airflow chamber 331 forms a space (hereinafter referred to as a "negative pressure creating space") 3311 in which negative pressure for sucking the sheet P onto the conveyor belt 32 is created. The airflow chamber 331 in the present embodiment is a box-shaped member that is a tube having an open top and a closed bottom. The airflow chamber 331 has side walls that are secured at the top to the guide member 332. The open top of the airflow chamber 331 is covered with the guide member 332. That is, the guide member 332 in the present embodiment serves as an upper wall of the airflow chamber 331.

The negative pressure creating section 336 creates negative pressure in the airflow chamber 331, and may for example be a fan or a vacuum pump. The negative pressure creating section 336 is disposed under the airflow chamber 331, specifically, connected to the bottom surface 3312 of the airflow chamber 331. The negative pressure creating section 336 creates negative pressure in the airflow chamber 331 by discharging air outward of the airflow chamber 331 through the gas outlet 337. The negative pressure created in the airflow chamber 331 acts on the sheet P through suction holes 321 (see FIG. 4) in the conveyor belt 32 and the through holes 335 in the guide member 332 to suck the sheet P onto the conveyor belt 32. As a result, the sheet P is sucked on the conveyor belt 32. In the above manner, the conveyance section 31 conveys the sheet P while sucking the sheet p onto the conveyor belt 32.

The plate member 35 is located upstream of the recording heads 34 in the conveyance direction of the sheet P (to the right in FIG. 2). In other words, the plate member 35 is located between the recording head 34*a* and the placing roller 312. The plate member 35 corresponds to part of a "gap forming section". A gap present between the plate member 35 and the guide member 332 corresponds to a narrow gap 35*a*, which will be described later.

Next, a description will be given of operation of the inkjet recording apparatus 1 with reference to FIG. 1. First, the sheet feed roller 22 picks up a sheet P from the sheet feed cassette 21. The sheet P is then guided by the guide plate 23 to the pair of first conveyance rollers 42.

The sheet P is fed by the pair of first conveyance rollers 42 into the sheet conveyance path 41 and then conveyed by the pair of second conveyance rollers 43 in the conveyance direction of the sheet P. The sheet P comes to stop upon contact with the pair of registration rollers 44 where skew correction of the sheet P is performed. The sheet P is subsequently fed to the image forming section 3 by the pair of registration rollers 44 in synchronization with timing of image formation.

The sheet P is guided to the conveyor belt 32 by the placing roller 312 and sucked onto the conveyor belt 32. Preferably, the sheet P is guided to the conveyor belt 32 such that the widthwise center of the sheet P coincides with the widthwise center of the conveyor belt 32. The sheet P covers some of the suction holes 321 (see FIG. 4) in the conveyor belt 32. The negative pressure applying section 33 sucks air through the guide member 332 and the conveyor belt 32. That is, the negative pressure applying section 33 creates negative pressure in the airflow chamber 331. The negative pressure acts on the sheet P and thus the sheet P is sucked onto the conveyor belt 32. The sheet P is conveyed in the conveyance direction of the sheet P as the conveyor belt 32 circulates.

The sheet P is then conveyed on the conveyor belt 32 sequentially to the regions opposite to the four types of recording heads 34*a*, 34*b*, 34*c*, and 34*d*. While the sheet P is conveyed on the conveyor belt 32, the four types of recording heads 34*a*, 34*b*, 34*c*, and 34*d* eject ink of respective colors toward the sheet P. This forms an image on the sheet P.

The sheet P is conveyed from the conveyor belt 32 to the conveyance guide 36. Once passed through the conveyance guide 36, the sheet P is fed toward the exit port 11 by the pair of ejection rollers 51 and ejected through the exit port 11 to be guided along the exit tray 52 out of the apparatus housing 100.

Figure 3:
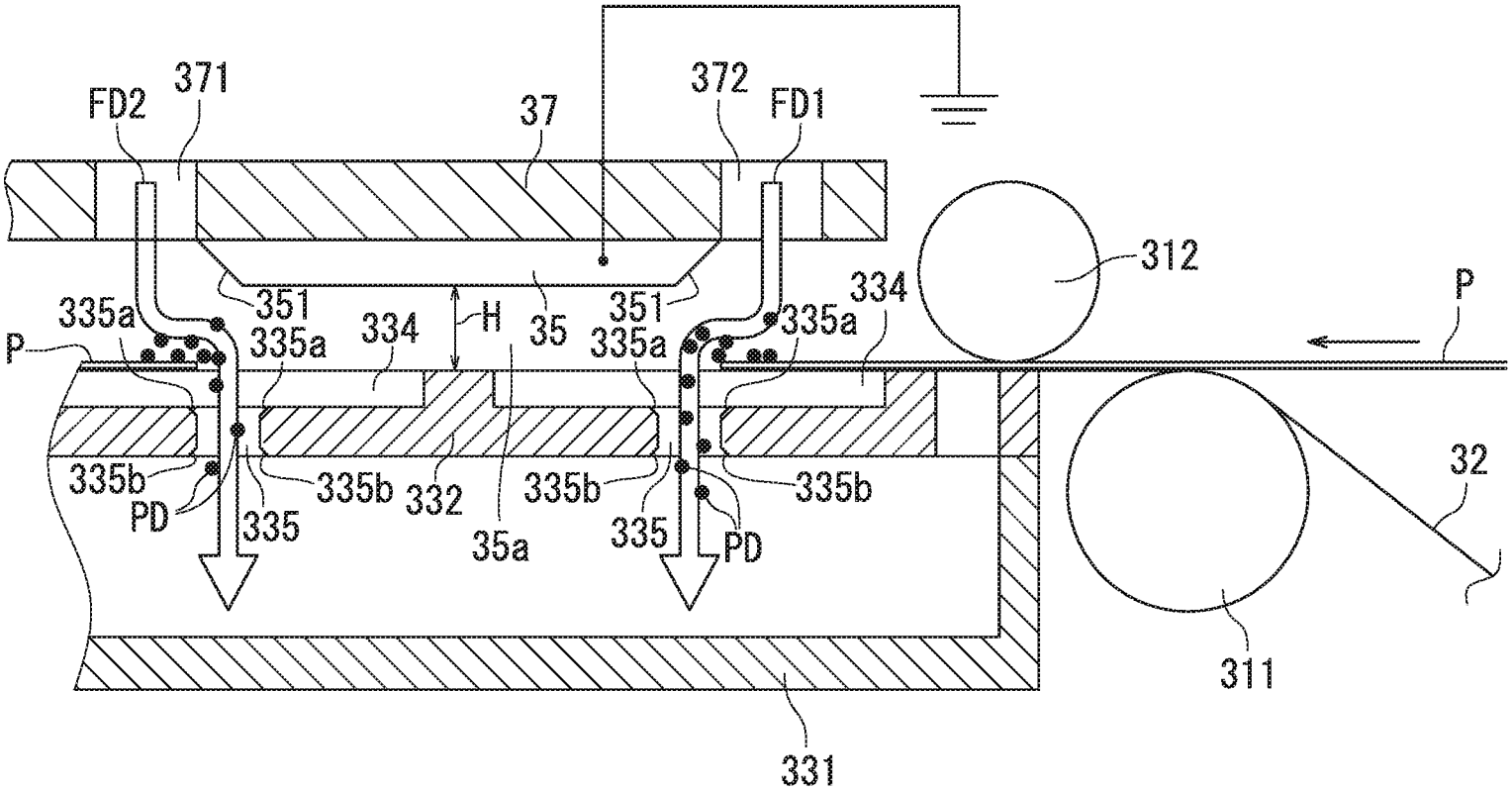
FIG. 3 illustrates structure around a plate member illustrated in FIG. 2.

Next, a description will be given of structure around the plate member 35 with reference to FIG. 3. FIG. 3 illustrates the structure around the plate member 35 illustrated in FIG. 2.

As illustrated in FIG. 3, the plate member 35 is secured to a head base 37. The head base 37 is a plate-like member for securing the recording head 34 in place. The head base 37 corresponds to part of the "gap forming section". A distance H across the narrow gap 35*a* is set so as to allow air flowing into the narrow gap 35*a* from surrounding space to have a higher flow velocity in the narrow gap 35*a* than before flowing into the narrow gap 35*a*. The distance H herein is a length of the narrow gap 35*a* in a direction perpendicular to the upper surface of the conveyor belt 32. In other words, the distance H is a vertical length (distance) of the narrow gap 35*a*. Specifically, the narrow gap 35*a* is formed between the lower surface of the plate member 35 and the upper surface of the conveyor belt 32 such that the vertical distance H is equal to or shorter than a threshold distance HS that is set in advance (for example, 3 mm) The plate member 35 is formed from an electrical conductor (metal such as aluminum) that is earthed. The upper surface of a part of the conveyor belt 32 that is in contact with the guide member 332 is an example of a "conveying surface". According to the present embodiment, the vertical distance H across the narrow gap 35*a* measures, for example, 2 mm.

The description given above with reference to FIG. 3 is directed to a situation in which the sheet P is sufficiently thin relative to the vertical distance H across the narrow gap 35*a*. Preferably, the vertical distance H across the narrow gap 35*a* is adjusted according to the thickness of the sheet P. Specifically, for example, it is preferable to lift the plate member 35 up and down according to the thickness of the sheet P to keep the distance between the upper surface of the sheet P and the lower surface of the plate member 35 substantially constant (for example, 2 mm).

The head base 37 has holes 371 and 372 for allowing air to flow into the narrow gap 35*a*. The hole 371 is located downstream (to the left in FIG. 3) of the plate member 35 in the conveyance direction of the sheet P, and the hole 372 is located upstream (to the right in FIG. 3). The holes 371 and 372 are elongated in the width direction of the sheet P (direction perpendicular to the drawing surface of FIG. 3).

The present embodiment is directed to a configuration in which the head base 37 has the holes 371 and 372 elongated in the width direction of the sheet P. Alternatively, however, the head base 37 may have holes having a different shape. The head base 37 may for example have a plurality of substantially cylindrical holes arranged in the width direction of the sheet P.

The holes 371 and 372 in the head base 37 allow air to flow into the narrow gap 35*a* and then into the airflow chamber 331 sequentially through the suction holes 321 in the conveyor belt 32 and the through holes 335 in the guide member 332. In other words, the airflow chamber 331 is under negative pressure created by the negative pressure creating section 336 (for example, at a pressure differing from the atmospheric pressure by about 0.005 atm≈about 500 Pa). Therefore, air present in the narrow gap 35*a* is drawn into the airflow chamber 331 sequentially through the suction holes 321 in the conveyor belt 32 and the through holes 335 in the guide member 332. In addition, as air is drawn out of the narrow gap 35*a* to the airflow chamber 331, air is drawn into the narrow gap 35*a* through the holes 371 and 372 in the head base 37.

As described above, air flows along paths indicated by arrows FD1 and FD2 in FIG. 3. In addition, the vertical distance H across the narrow gap 35*a* is set to be equal to or shorter than the threshold distance HS that is set in advance. Consequently, the flow velocity increases in the narrow gap 35*a*. The flow velocity in the narrow gap 35*a* is preferably at least 6.0 m/sec, for example.

As described above, air blowing along the path indicated by the arrow FD1 flows from upstream to downstream in the conveyance direction of the sheet P in the narrow gap 35*a* (to the left in FIG. 3). Consequently, as illustrated in FIG. 3, paper dust PD attached to the leading edge (left edge in FIG. 3) of the sheet P can be removed and collected into the airflow chamber 331. By contrast, air blowing along the path indicated by the arrow FD2 flows from downstream to upstream in the conveyance direction of the sheet P in the narrow gap 35*a* (to the right in FIG. 3). Consequently, paper dust PD attached to the trailing edge (right edge in FIG. 3) of the sheet P can be removed and collected into the airflow chamber 331. This can ensure effective removal of paper dust attached to the sheet P.

As described above, the plate member 35 is formed from an earthed electrical conductor and thus will not be charged. Therefore, the plate member 35 can be ensured not to attract paper dust even though the paper dust may be charged.

As described above, attachment of the plate member 35 can be facilitated by securing the plate member 35 to the head base 37. In addition, the head base 37 has the holes 371 and 372 allowing air to flow into the narrow gap 35*a* and thus is able to ensure smooth flow of air into the narrow gap 35*a*.

The present embodiment is directed to a configuration in which the plate member 35 is secured to the head base 37. Alternatively, however, the plate member 35 may be secured to the apparatus housing 100 illustrated in FIG. 1. For example, the apparatus housing 100 may be provided with a securing member extended therefrom to hold the plate member 35 at opposite ends in the width direction of the plate member 35 (direction perpendicular to the drawing surface of FIG. 3). In this configuration, no component member obstructs air flowing into the narrow gap 35*a* from downstream and upstream in the conveyance direction of the sheet P. Therefore, the flow velocity of air in the narrow gap 35*a* can increase to a greater extent. Consequently, paper dust can be removed more effectively.

As illustrated in FIG. 3, the plate member 35 has tapered portions 351 such that the distance across the narrow gap 35*a* in the direction perpendicular to the upper surface of the conveyor belt 32 is greater toward either edge of the plate member 35 in the conveyance direction of the sheet P (horizontal direction in FIG. 3). Specifically, one of the tapered portions 351 that is on the right in FIG. 3 is formed such that the distance across the narrow gap 35*a* in the direction perpendicular to the upper surface of the conveyor belt 32 is greater toward the upstream edge of the plate member 35 in the conveyance direction of the sheet P (the horizontal direction in FIG. 3). Similarly, one of the tapered portions 351 that is on the left in FIG. 3 is formed such that the distance across the narrow gap 35*a* in the direction perpendicular to the upper surface of the conveyor belt 32 is greater toward the downstream edge of the plate member 35 in the conveyance direction of the sheet P (the horizontal direction in FIG. 3). In other words, the tapered portions 351 are formed at an upstream end and a downstream end of the plate member 35 in the conveyance direction of the sheet P such that the plate member 35 is thinner toward either edge of the plate member 35 in the conveyance direction of the sheet P.

As described above, the plate member 35 is provided with the tapered portions 351 such that the distance across the narrow gap 35*a* in the direction perpendicular to the upper surface of the conveyor belt 32 is greater toward either edge of the plate member 35 in the conveyance direction of the sheet P (the horizontal direction in FIG. 3). This configuration enables reduction in pressure loss of air flowing along the plate member 35. Therefore, the flow velocity of air in the narrow gap 35*a* can increase to remove paper dust even more effectively.

Figure 4:
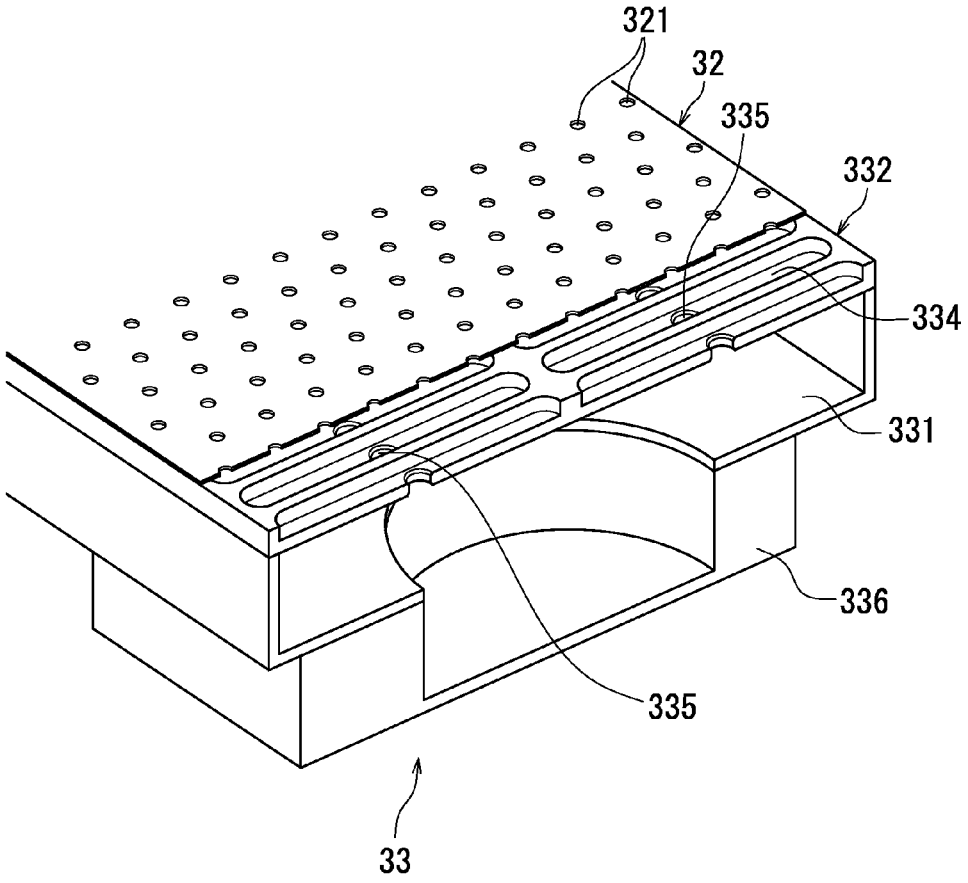
FIG. 4 is a cross sectional perspective view illustrating structure of a conveyor belt, a guide member, and a negative pressure applying section illustrated in FIG. 2.

Next, a description will be given of structure of the conveyor belt 32, the guide member 332, and the negative pressure applying section 33, with reference to FIG. 4. FIG. 4 is a cross sectional perspective view illustrating the structure of the conveyor belt 32, the guide member 332, and the negative pressure applying section 33 illustrated in FIG. 2.

As illustrated in FIG. 4, the conveyor belt 32, the guide member 332, the airflow chamber 331, and the negative pressure creating section 336 are located in order from top to bottom. The conveyor belt 32 has a plurality of suction holes 321 perforated therethrough.

The following describes the suction holes 321 in the conveyor belt 32. As illustrated in FIG. 4, the suction holes 321 are formed in the conveyor belt 32 at substantially equal intervals. The suction holes 321 each have a diameter of, for example, 2 mm. The spacing between adjacent suction holes 321 is, for example, 8 mm.

The guide member 332 has a plurality of grooves 334 in the upper surface (surface facing toward the conveyor belt 32). The grooves 334 have a shape of an oval elongated in the conveyance direction of the sheet P.

Figure 5:
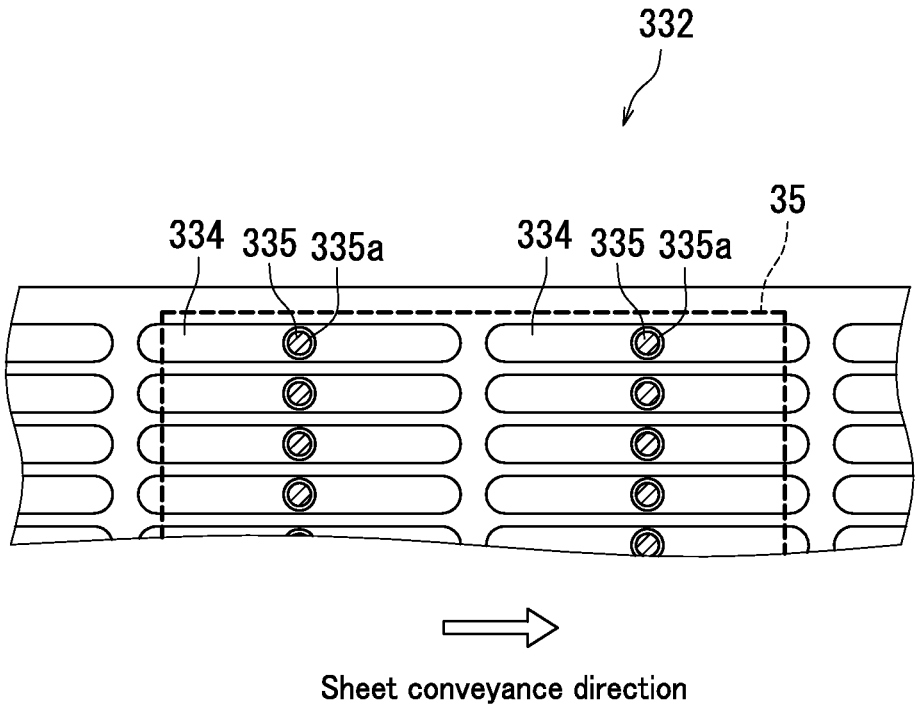
FIG. 5 is a plan view illustrating structure of the guide member illustrated in FIG. 4.

With reference to FIG. 5, the following describes the grooves 334 and the through holes 335 formed in the guide member 332. FIG. 5 is a plan view illustrating structure of the guide member 332 illustrated in FIG. 4. As illustrated in FIG. 5, the guide member 332 has the grooves 334 each having a shape of an oval elongated in the conveyance direction of the sheet P (horizontal direction in FIG. 5). The grooves 334 are arranged in a plurality of rows that are next to one another in the width direction of the guide member 332 (vertical direction in FIG. 5). Each groove 334 has a through hole 335 that penetrates the guide member 332 in the thickness direction thereof substantially at the center of the groove 334 in the conveyance direction of the sheet P (the horizontal direction in FIG. 5). Each through hole 335 is substantially circular in cross section.

FIG. 5 indicates, in dashed lines, a projected position of the plate member 35 on the guide member 332. The projected image of the plate member 35 on the guide member 332 overlaps with two columns of through holes 335, one at an upstream side in the conveyance direction of the sheet P (left in FIG. 5) and the other at a downstream side (right in FIG. 5). The grooves 334 containing the through holes 335 that are in the upstream column in the conveyance direction of the sheet P (to the left in FIG. 5) each extend further upstream beyond the upstream edge (left edge in FIG. 5) of the projected image of the plate member 35. Similarly, the grooves 334 containing the through holes 335 that are in the downstream column in the conveyance direction of the sheet P (to the right in FIG. 5) each extend further downstream beyond the downstream edge (right edge in FIG. 5) of the projected image of the plate member 35.

Figure 6A:
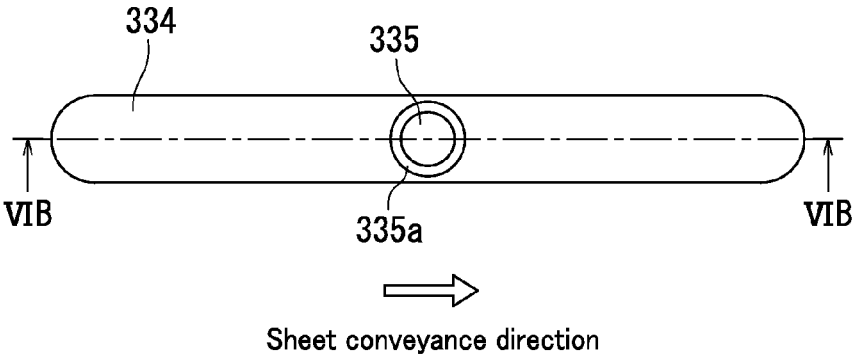
FIG. 6A is a plan view illustrating structure of a groove and a through hole formed in the guide member illustrated in FIG. 5.
Figure 6B:
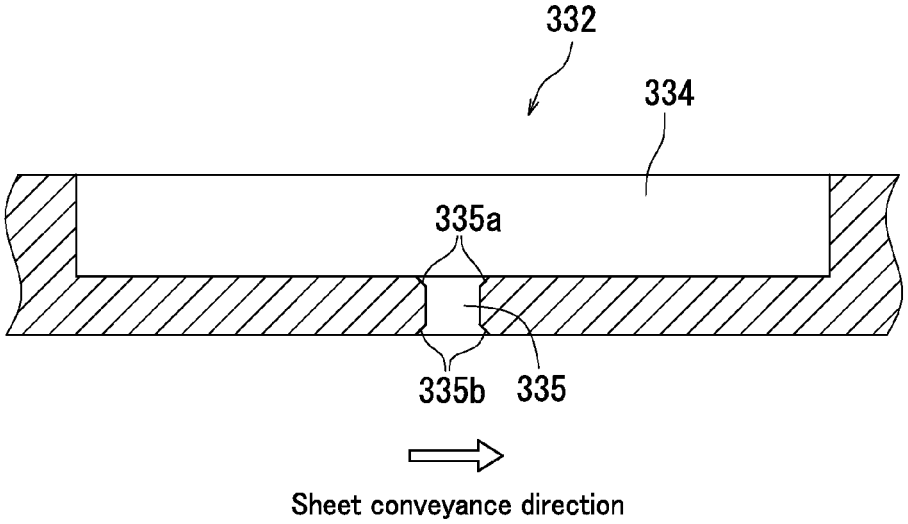
FIG. 6B is a cross sectional view illustrating structure of the groove and the through hole formed in the guide member illustrated in FIG. 5.

Next, a description will be given of the grooves 334 and the through holes 335 of the guide member 332 with reference to FIGS. 6A and 6B. FIG. 6A is a plan view illustrating the structure of the groove 334 and the through hole 335 formed in the guide member in FIG. 5. FIG. 6B is a cross sectional view illustrating the structure of the groove 334 and the through hole 335 formed in the guide member in FIG. 5.

As illustrated in FIG. 6A, the groove 334 has the through hole 335 that penetrates the guide member 332 in the thickness direction thereof substantially at the center of the groove 334 in the conveyance direction of the sheet P (horizontal direction in FIG. 6A). As illustrated in the 6B, the groove 334 is continuous with the through hole 335, and therefore negative pressure created in the airflow chamber 331 affects an inner region of the groove 334 through the through hole 335. The through hole 335 has a tapered portion 335*a* formed at an upper mouth and a tapered portion 335*b* formed at a lower mouth.

As described above, the grooves 334 are located in a region opposite to the plate member 35. Therefore, negative pressure created in the airflow chamber 331 affects the inner regions of the grooves 334 through the through holes 335. This can further facilitate flow of air along the paths indicated by the arrows FD1 and FD2 indicated in FIG. 3. Consequently, more effective removal of paper dust is enabled.

As described above, the tapered portion 335*a* at the upper mouth and the tapered portion 335*b* at the lower mouth of each through hole 335 are effective to reduce pressure loss of air flowing through the through hole 335. This can further facilitate flow of air along the paths indicated by the arrows FD1 and FD2 in FIG. 3. Consequently, more effective removal of paper dust is enabled.

The present embodiment is directed to a configuration in which each through hole 335 has both the tapered portions 335*a* and 335*b* respectively at the upper mouth and the lower mouth. Alternatively, however, each through hole 335 may have one tapered portion at either the upper or lower mouth.

Referring back to FIG. 4, a description will be given of the relative positions of the suction holes 321 in the conveyor belt 32 and the grooves 334 in the guide member 332. The conveyor belt 32 has the suction holes 321 arranged in a plurality of rows in the conveyance direction of the sheet P. The rows of suction holes 321 are next to one another in the width direction of the conveyor belt 32 (direction perpendicular to the conveyance direction of the sheet P) such that the suction holes 321 in adjacent rows are staggered. As illustrated in FIG. 4, the respective rows of the suction holes 321 in the conveyor belt 32 are located opposite to the rows of the grooves 334 in the guide member 332.

Each groove 334 is arranged so as to be opposite to at least two of the suction holes 321 at all times. The suction holes 321 that are opposite to the grooves 334 change one-by-one as the conveyor belt 32 circulates.

The airflow chamber 331, which is under negative pressure created by the negative pressure creating section 336, is in communication with the suction holes 321 in the conveyor belt 32 through the through holes 335 and the grooves 334 of the guide member 332.

Therefore, negative pressure is applied to the suction holes 321 of the conveyor belt 32 and thus the conveyor belt 32 can convey a sheet P with the sheet P sucked onto the conveyor belt 32.

Figure 7:
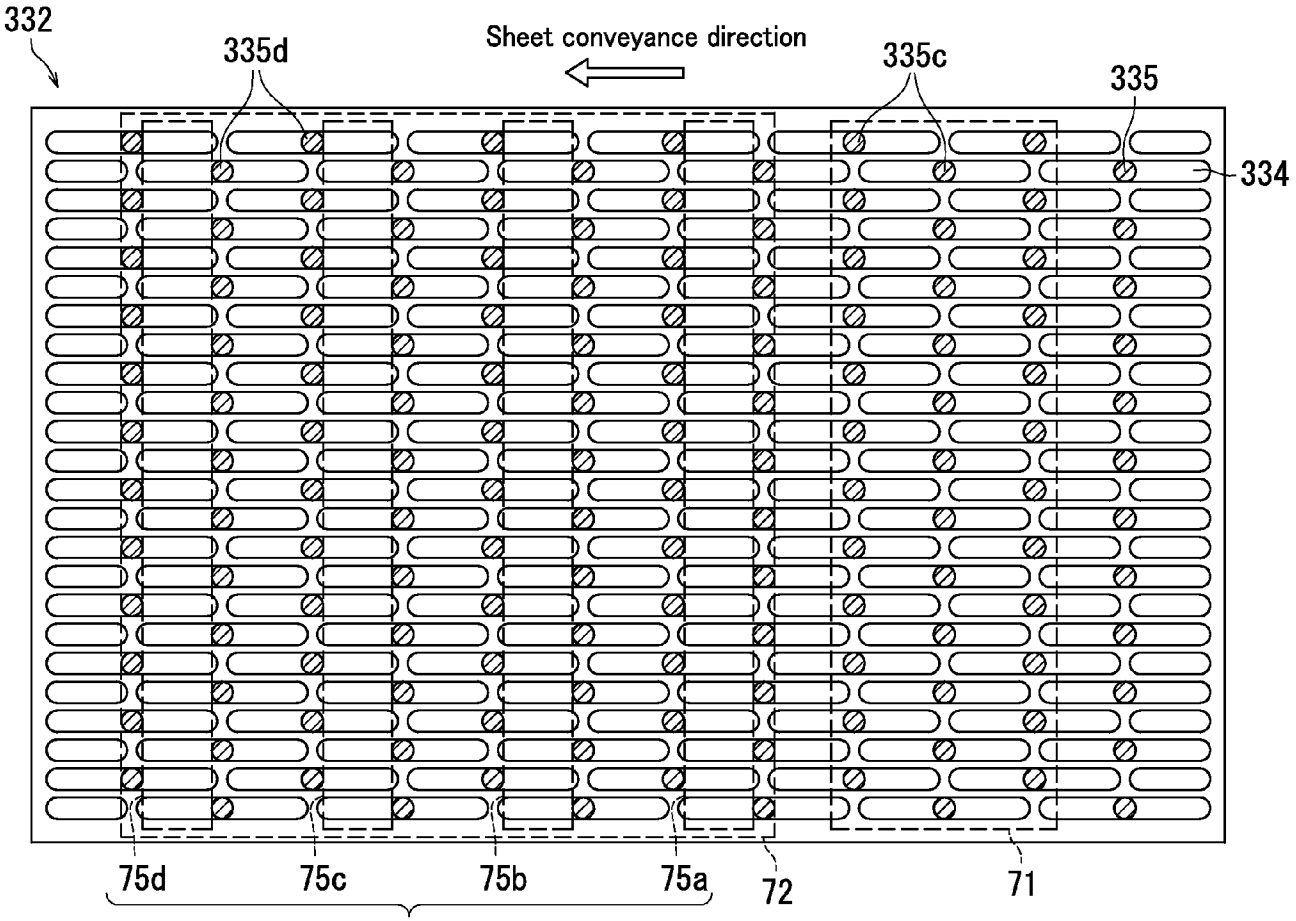
FIG. 7 is a plan view of the guide member illustrated in FIG. 2.

FIG. 7 is a plan view of the guide member 332 (upper wall of the airflow chamber 331) in FIG. 2.

Rectangular regions 75 (75*a*, 75*b*, 75*c*, and 75*d*) in FIG. 7 are regions of the guide member 332 that are located opposite to the respective recording heads 34 (hereinafter referred to as head facing regions). The conveyor belt 32 is located between the recording heads 34 and the guide member 332. More precisely, the head facing regions 75 are regions of the guide member 332 that face the respective recording heads 34 with the conveyor belt 32 therebetween. The head facing region 75*a* faces the recording head 34*a*. The head facing region 75*b* faces the recording head 34*b*. The head facing region 75*c* faces the recording head 34*c*. The head facing region 75*d* faces the recording head 34*d*.

Note that the image forming section 3 includes a single recording head 34 for each of the four types but may include a plurality of recording heads 34 of each of the four types. In a configuration with a plurality of recording heads 34 of each type, the recording heads 34 of each type are staggered in the width direction of the guide member 332 (direction perpendicular to the conveyance direction of the sheet P).

Referring to FIG. 7, a rectangular region 71 is a given region of the guide member 332 located upstream of the head facing regions 75 in the conveyance direction of the sheet P (to the right in FIG. 7). Hereinafter, the given region is referred to as a "first region". The first region 71 in the present embodiment corresponds to a region where the plate member 35 is located, that is, a region opposite to the plate member 35 with the conveyor belt 32 therebetween. In other words, the narrow gap 35*a* is located above the first region 71.

Referring further to FIG. 7, a rectangular region 72 is located downstream of the first region 71 in the conveyance direction of the sheet P (to the left in FIG. 7) and includes the head facing regions 75. Hereinafter, the rectangular region 72 is referred to as a "second region". Ink ejection toward the sheet P (image formation) is performed above the second region 72. Hereafter, a space 341 (see FIGS. 8 and 9) above the second region 72 in which image formation is performed is referred to as an "image formation space".

The negative pressure applying section 33 in the present embodiment applies greater negative pressure through first through holes 335*c* (first holes) than that through second through holes 335*d* (second holes). Here, the first through holes 335*c* are located in the first region 71. The second through holes 335*d* are located in the second region 72. The first and second through holes 335*c* and 335*d* are included among the through holes 335.

In the above configuration, the amount of air sucked through each first through hole 335*c* is greater than that of air sucked through each second through hole 335*d*. The amount of air sucked through a through hole 335 herein means an amount of air sucked through the through hole 335 per unit time. As a result, the flow velocity of air (air flowing toward the airflow chamber 331) to be sucked through the first region 71 (in the narrow gap 35*a*) increases. The inkjet recording apparatus 1 with the above configuration accordingly can efficiently collect paper dust upstream of the image formation space 341 in the conveyance direction of the sheet P. Thus, in the inkjet recording apparatus 1, the amount of paper dust conveyed to the image formation space 341 can be reduced. This can result in effective prevention of attachment of paper dust to the nozzles.

In the above configuration, the flow velocity of air to be sucked through the second region 72 (in the image formation space 341) decreases. Thus, in the inkjet recording apparatus 1, paper dust can be prevented from stirring up in the image formation space 341 and accordingly be further prevented from being attached to the nozzles.

Any of various schemes may be adopted as a scheme for setting the negative pressure applied through the first through holes 335*c* to be greater than that applied through the second through holes 335*d*. For example, any of the following schemes can be adopted.

Scheme 1: The area of an opening of each first through hole 335*c* is set greater than that of an opening of each second through hole 335*d*.

Scheme 2: The depth of each first through hole 335*c* is set shallower than that of each second through hole 335*d*.

Scheme 3: The negative pressure creating section 336 is disposed under the bottom surface 3312 of the airflow chamber 331 below the first region 71.

Scheme 4: The depth of a region of the airflow chamber 331 below the first region 71 (depth of the negative pressure generation space 3311) is set greater than that of a region of the airflow chamber 331 below the second region 72. Further, the negative pressure creating section 336 is connected to a portion of the bottom surface 3312 of the airflow chamber 331 that corresponds to the region having the greater depth.

Scheme 5: The airflow chamber 331 (the negative pressure generation space 3311) is partitioned into a first space 331*a* located in correspondence with the first region 71 and a second space 331*b* located in correspondence with the second region 72. Negative pressure in the first space 331*a* is set greater than that in the second space 331*b*.

Scheme 4 will be described specifically with reference to FIG. 8. Then, Scheme 5 will be described specifically with reference to FIGS. 9 and 10.

Figure 8:
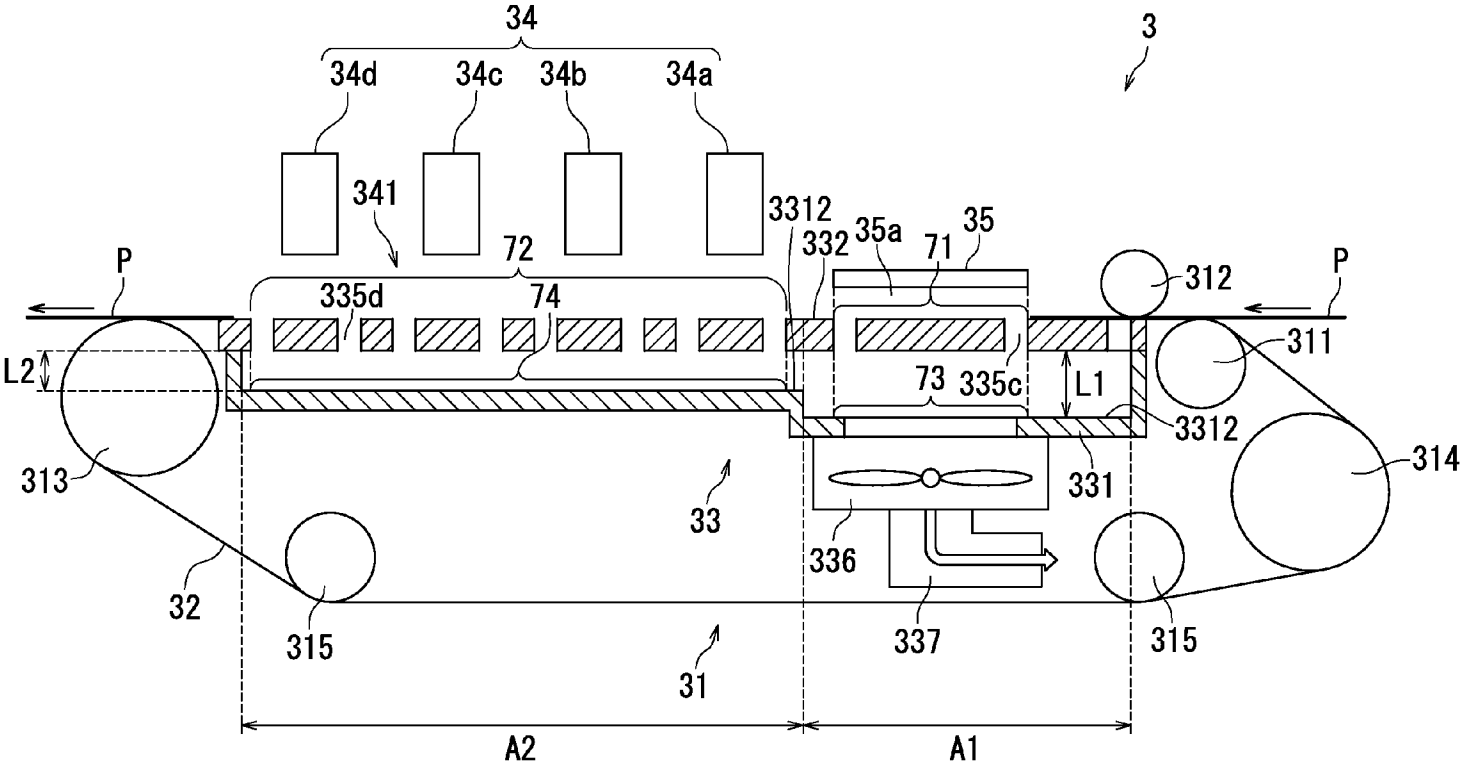
FIG. 8 illustrates a first configuration example of an airflow chamber illustrated in FIG. 2.

FIG. 8 illustrates a first configuration example of the airflow chamber 331 illustrated in FIG. 2. Although the grooves 334 are not illustrated in FIG. 8, the respective through holes 335 are located in the bottom surfaces of the respective grooves 334 formed in the upper surface of the guide member 332.

The airflow chamber 331 in the first configuration example has a first portion A1 having a greater depth and a second portion A2 having a shallower depth. A distance L1 represents the depth of the airflow chamber 331 in the first portion A1, that is, the distance between the bottom surface 3312 and the guide member 332 serving as the upper wall in the first portion A1. A distance L2 represents the depth of the airflow chamber 331 in the second portion A2, that is, the distance between the bottom surface 3312 and the guide member 332 serving as the upper wall in the second portion A2. The distance L1 is greater than the distance L2.

The bottom surface 3312 in the first portion A1 includes a third region 73. The third region 73 herein is a region of the bottom surface 3312 of the airflow chamber 331 that is located in correspondence with the first region 71. In other words, the third region 73 is located opposite to the plate member 35 with the conveyor belt 32 and the guide member 332 therebetween and below the narrow gap 35*a*. By contrast, the bottom surface 3312 in the second portion A2 includes a fourth region 74. The fourth region 74 herein is a region of the bottom surface 3312 of the airflow chamber 331 that is located in correspondence with the second region 72, that is, a region below the image formation space 341.

The negative pressure creating section 336 is connected to the bottom surface 3312 of the first portion A1, for example, in the third region 73. Another negative pressure creating section 336 connected to the bottom surface 3312 may be provided in the second portion A2, in addition to one connected to the bottom surface 3312 in the first portion A1.

In the configuration illustrated in FIG. 8, the negative pressure applied through the first through holes 335*c* can be set greater than that applied through the second through holes 335*d*. Thus, the flow velocity of the air flowing above the first region 71 (in the narrow gap 35*a*) increases. The inkjet recording apparatus 1 in the above configuration can effectively collect paper dust upstream of the image formation space 341 in the conveyance direction of the sheet P (to the right in FIG. 8). Thus, in the inkjet recording apparatus 1, the amount of paper dust conveyed to the image formation space 341 can be reduced, thereby enabling effective prevention of attachment of paper dust to the nozzles. In the above configuration, the flow velocity of air flowing above the second region 72 (in the image formation space 341) decreases. Thus, in the inkjet recording apparatus 1, paper dust can be prevented from stirring up in the image formation space 341 and accordingly prevented from being attached to the nozzles.

Figure 9:
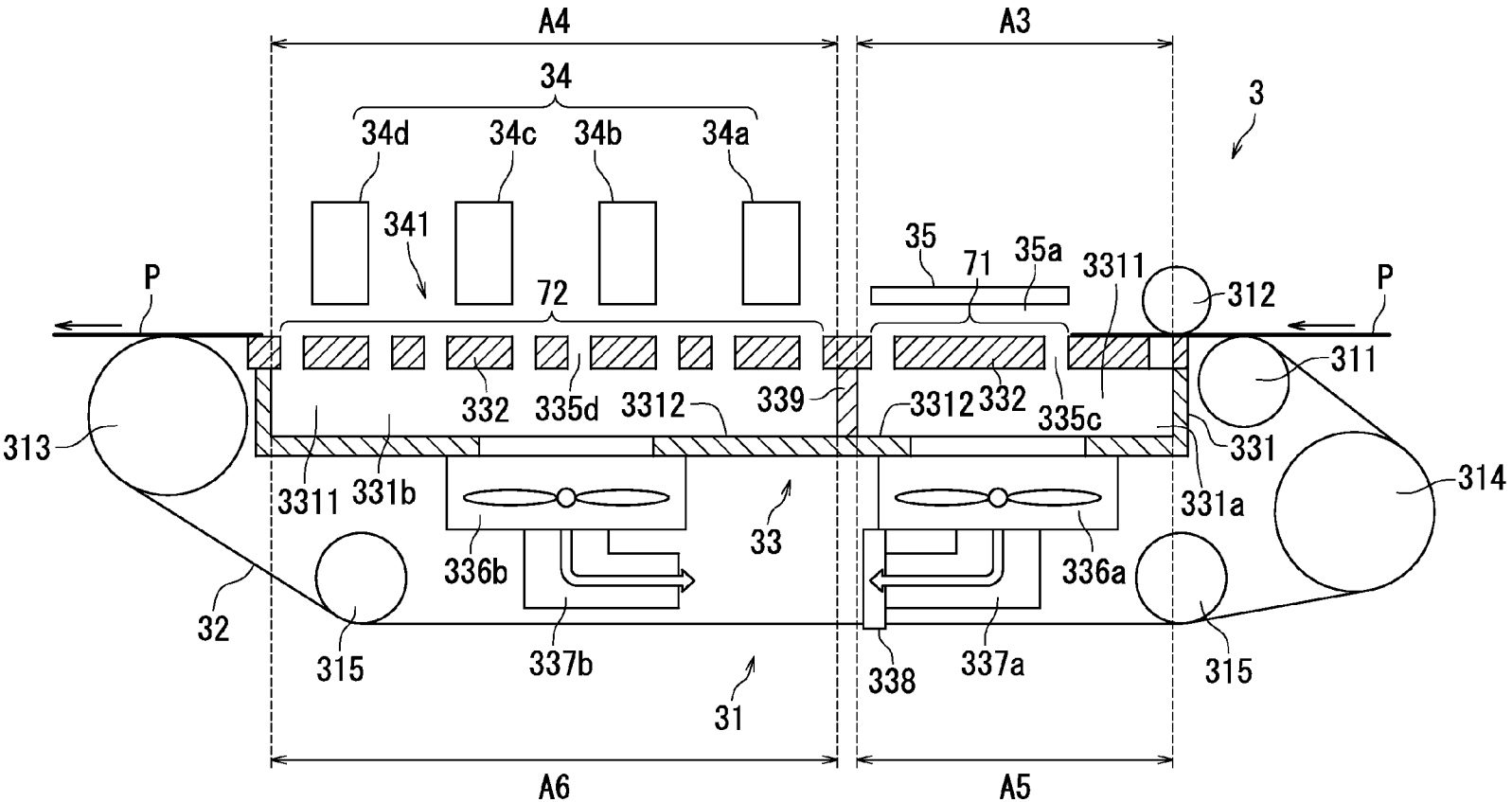
FIG. 9 illustrates a second configuration example of the airflow chamber illustrated in FIG. 2.

FIG. 9 illustrates a second configuration example of the airflow chamber 331 illustrated in FIG. 2. Although FIG. 9 does not illustrate the grooves 334, the respective through holes 335 are located in the bottom surfaces of the respective grooves 334 formed in the upper surface of the guide member 332.

In the second configuration example, the airflow chamber 331 (the negative pressure generation space 3311) is partitioned into the first space 331*a* located in correspondence with the first region 71 and the second space 331*b* located in correspondence with the second region 72. A portion A3 of the guide member 332 (the upper wall) that forms the first space 331*a* includes the first region 71. In the above configuration, negative pressure created in the first space 331*a* causes air to be sucked through the first through holes 335*c* in the first region 71. A portion A4 of the guide member 332 (the upper wall) that forms the second space 331*b* includes the second region 72. In the above configuration, negative pressure created in the second space 331*b* causes air to be sucked through the second through holes 335*d* in the second region 72.

The negative pressure applying section 33 in the second configuration example includes two negative pressure creating sections 336 (first and second negative pressure creating sections 336*a* and 336*b*) and two gas outlets 337 (first and second gas outlets 337*a* and 337*b*). The first negative pressure creating section 336*a* is connected to the bottom surface 3312 of a portion A5 of the airflow chamber 331 that forms the first space 331*a*. The second negative pressure creating section 336*b* is connected to the bottom surface 3312 of a portion A6 of the airflow chamber 331 that forms the second space 331*b*.

The first negative pressure creating section 336*a* discharges air outward of the first space 331*a* through the first gas outlet 337*a* to create negative pressure in the first space 331*a*. The second negative pressure creating section 336*b* discharges air outward of the second space 331*b* through the second gas outlet 337*b* to create negative pressure in the second space 331*b*.

Here, the operating rates of the first and second negative pressure creating sections 336*a* and 336*b* (the rotational speed of each fan in a configuration in which the negative pressure creating sections 336 are fans) are set so that the amount of air discharged by the first negative pressure creating section 336*a* per unit time is greater than that of air discharged by the second negative pressure creating section 336*b* per unit time. In the above configuration, the negative pressure in the first space 331*a* is greater than that in the second space 331*b*.

In the configuration illustrated in FIG. 9, the negative pressure applied through the first through holes 335*c* can be set greater than that applied through the second through holes 335*d*. Thus, the flow velocity of air flowing above the first region 71 (in the narrow gap 35*a*) increases. Therefore, paper dust can be effectively corrected upstream of the image formation space 341 in the conveyance direction of the sheet P (to the right in FIG. 9), that is, in the narrow gap 35*a* in the inkjet recording apparatus 1. Thus, in the inkjet recording apparatus 1, the amount of paper dust conveyed to the image formation space 341 can be reduced, thereby enabling effective prevention of attachment of paper dust to the nozzles. In the above configuration, the flow velocity of air flowing above the second region 72 (in the image formation space 341) decreases. Thus, in the inkjet recording apparatus 1, paper dust can be prevented from stirring up in the image formation space 341 and accordingly prevented from being attached to the nozzles.

Figure 10:
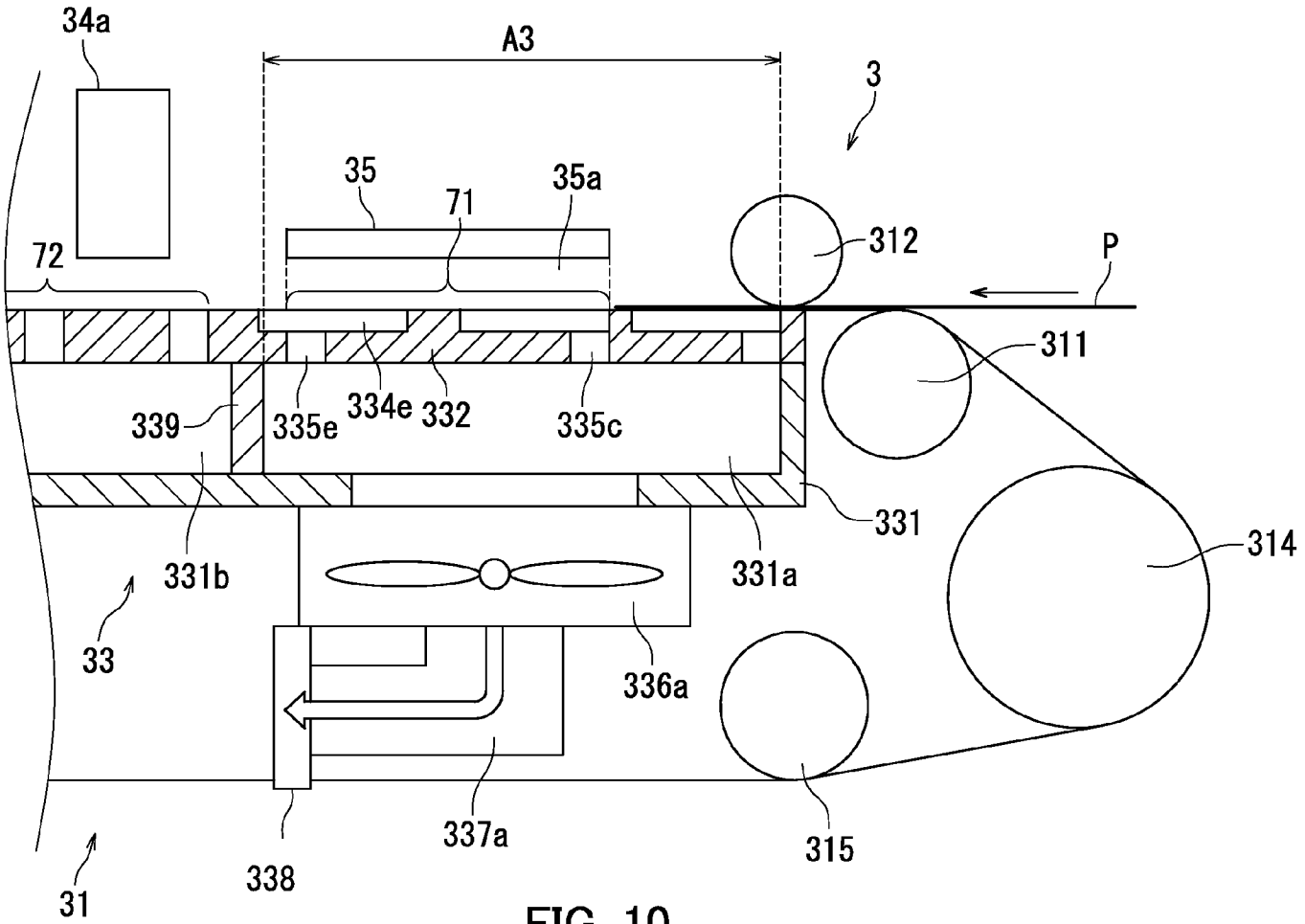
FIG. 10 is an enlarged view of a first space in the airflow chamber illustrated in FIG. 9.

FIG. 10 is an enlarged view of the first space 331*a* in the airflow chamber 331 illustrated in FIG. 9.

As illustrated in FIG. 10, the airflow chamber 331 is partitioned into the first and second spaces 331*a* and 331*b* by a partition plate 339 such that third through holes 335*e* are located in a region of the first space 331*a*. That is, the third through holes 335*e* are located in the portion A3 of the guide member 332 (the upper wall) that forms the first space 331*a*. The third through holes 335*e* herein are each located in the bottom surface of a corresponding one of grooves 334*e* that extend from the first region 71 further downstream in the conveyance direction of the sheet P (to the left in FIG. 10) beyond the first region 71.

As described above, negative pressure applied from the airflow chamber 331 through the through holes 335 affects the inner regions of the grooves 334 where the through holes 335 are located. Accordingly, even in a configuration in which the third through holes 335*e* are located outside the first region 71, negative pressure applied through the third through holes 335*e* affects also a space above the first region 71 as long as at least a part of the respective grooves 334*e* that have the third through holes 335*e* are located in the first region 71. Partition of the airflow chamber 331 as above can allow comparatively high negative pressure in the first space 331*a*, that is, negative pressure applied through the through holes 335 located in the first space 331*a* to affect the space above the first region 71.

The collection member 338 for collecting foreign matter such as paper dust is disposed at a downstream end of the first gas outlet 337*a* in a direction of airflow. The collection member 338 may be a filter, for example. The collection member 338 collects paper dust mixed with air that is to be discharged outward of the first space 331*a*. In the above configuration, a situation in which paper dust sucked in the first space 331*a* is discharged through the first gas outlet 337*a* and scattered in the inkjet recording apparatus 1 can be prevented. Note that another collection member 338 may be disposed at the downstream end of the second gas outlet 337*b* in a direction of airflow, in addition to the collection member 338 at the first gas outlet 337*a*.

An embodiment of the present disclosure has been described so far with reference to the accompanying drawings. Note that the present disclosure is not limited to the above embodiment, and a wide range of alterations can be made to the embodiment so long as such alterations do not deviate from the intended scope of the present disclosure (e.g., (1) to (5) below). The drawings are schematic illustrations that emphasize elements of configuration in order to facilitate understanding thereof. Therefore, properties of each of the elements, such as thickness, length, and number thereof, may differ from actual properties of the element. The properties of each of the elements, such as shape and dimension thereof described above are mere examples and not limited specifically. A wide range of variations of the properties can be made to the embodiment so long as such variations do not deviate from the intended scope of the present disclosure.

(1) The plate member 35 is disposed at a location upstream of the recording heads 34 in the conveyance direction of the sheet P and corresponding to the first region 71 in the present embodiment. However, the plate member 35 may be dispensed with. Even in a configuration without the plate member 35, it is only required that the negative pressure applying section 33 applies greater negative pressure through the first through holes 335*c* than that through the second through holes 335*d*.

(2) The negative pressure applying section 33 includes, but is not limited to, the two negative pressure creating sections 336 for the airflow chamber 331 in the second configuration example. Alternatively, a single negative pressure creating section may be provided. In a configuration with a single negative pressure creating section 336, the negative pressure creating section 336 is disposed, for example, under the bottom surface 3312 of a portion 5A of the airflow chamber 331 that forms the first space 331*a*. A gap is formed between the partition plate 339 and the upper wall, a side wall, or the bottom wall of the airflow chamber 331 so as to allow air to move between the first and second spaces 331*a* and 331*b*. In the above configuration, negative pressure in the first space 331*a* can be greater than that in the second space 331*b*.

(3) The present embodiment describes a configuration in which the conveyor belt 32 conveys the sheet P in the image forming section 3. Alternatively, however, the image forming section 3 may employ a different method for conveying a sheet P. For example, a plurality of conveyance rollers may be used to convey the sheet P. In this variation, negative pressure is preferably applied through a gap between adjacent conveyance rollers.

(4) The above embodiment describes a configuration in which the narrow gap 35*a* is formed by the plate member 35. This, however, should not be construed as limiting. The narrow gap 35*a* may be formed in another way. For example, the head base 37, which is located upstream of the recording head 34 in the conveyance direction of the sheet P, may be provided with part extending toward the conveyor belt 32 so as to form the narrow gap 35*a*. This variation can simplify the structure.

Alternatively, instead of the plate member 35, a belt stretched around two rollers may be employed to form the narrow gap 35*a*. Specifically, this variation employs a drive roller, a driven roller, and an endless belt in such position that the endless belt stretched around the drive roller and the driven roller is substantially parallel to the upper surface of the conveyor belt 32. The narrow gap 35*a* is formed between the lower surface of the endless belt and the upper surface of the conveyor belt 32. In this variation, once a region of the endless belt located on a lower side is contaminated with paper dust, the endless belt can be circulated to position a region not yet contaminated with paper dust on the lower side. This can effectively reduce the required frequency of paper dust removal from the endless belt by, for example, a service person.

(5) The above embodiments describe a configuration in which the guide member 332 and the airflow chamber 331 are separate components. The guide member 332 may be integral with the airflow chamber 331. This variation enables prevention of unintentional release of negative pressure from the airflow chamber 331 (air flowing into the airflow chamber 331 through a gap between the guide member 332 and the airflow chamber 331).

What is claimed is:

1. An inkjet recording apparatus comprising:

a conveyance section having a conveying surface on which a recording medium is to be placed and configured to convey the recording medium while the recording medium is placed on the conveying surface, the conveying surface having a plurality of holes;

a recording head configured to eject ink onto the recording medium being conveyed by the conveyance section;

a negative pressure applying section including an airflow chamber that has an upper wall having a plurality of holes and in which negative pressure for sucking the recording medium is created, the negative pressure applying section being configured to suck the recording medium by the negative pressure through the holes in the upper wall and the holes in the conveying surface to cause the recording medium to be sucked onto the conveying surface; and a gap forming section that is disposed at a location upstream of the recording head in the conveyance direction of the recording medium and corresponding to the first region of the upper wall of the airflow chamber to form a narrow gap with the conveying surface of the conveyance section, wherein negative pressure applied through a plurality of first holes among the holes in the upper wall is greater than negative pressure applied through a plurality of second holes among the holes in the upper wall, the first holes are located in a first region of the upper wall, the second holes are located in a second region of the upper wall, the first region is located upstream of a head facing region of the upper wall in a conveyance direction of the recording medium, the head facing region is located opposite to the recording head with the conveying surface therebetween, the second region is located downstream of the first region in the conveyance direction of the recording medium and includes the head facing region, and a distance across the narrow gap in a direction perpendicular to the conveying surface is set so as to allow air flowing into the narrow gap from surrounding space to have a higher flow velocity in the narrow gap than before flowing into the narrow gap.

2. The inkjet recording apparatus according to claim 1, wherein the negative pressure applying section further includes a negative pressure creating section configured to create negative pressure in the airflow chamber, a distance between the upper wall and a bottom surface of the airflow chamber that faces the upper wall is greater with respect to a third region of the bottom surface than with respect to a fourth region of the bottom surface, the third region is located in correspondence with the first region of the upper wall, the fourth region is located in correspondence with the second region of the upper wall, and the negative pressure creating section is disposed under the third region.

3. The inkjet recording apparatus according to claim 2, wherein the negative pressure applying section further includes a gas outlet, and the negative pressure creating section creates negative pressure in the airflow chamber by discharging air outward of the airflow chamber through the gas outlet.

4. The inkjet recording apparatus according to claim 1, wherein the airflow chamber is partitioned into a first space and a second space, a portion of the upper wall that forms the first space includes the first region, a portion of the upper wall that forms the second space includes the second region, and negative pressure in the first space is greater than negative pressure in the second space.

5. The inkjet recording apparatus according to claim 4, wherein the negative pressure applying section further includes a first negative pressure creating section connected to a portion of a bottom surface of the airflow chamber that faces the upper wall of the airflow chamber and configured to create negative pressure in the first space, the portion of the bottom surface forming the first space; and a second negative pressure creating section connected to another portion of the bottom surface of the airflow chamber that faces the upper wall of the airflow chamber and configured to create negative pressure in the second space, the other portion of the bottom surface forming the second space.

6. The inkjet recording apparatus according to claim 4, wherein the upper wall of the airflow chamber has a plurality of grooves, the holes in the upper wall are each located in a bottom surface of a corresponding one of the grooves, the airflow chamber is partitioned into the first space and the second space such that the portion of the upper wall that forms the first space has a third hole, a groove among the plurality of grooves extends from the first region of the upper wall downstream in the conveyance direction of the recording medium beyond the first region, and the third hole is located in a bottom surface of the groove.

7. The inkjet recording apparatus according to claim 6, wherein the negative pressure applying section further includes:

a first negative pressure creating section connected to a portion of the bottom surface of the airflow chamber that faces the upper wall of the airflow chamber and configured to create negative pressure in the first space, the portion of the bottom surface forming the first space; and a second negative pressure creating section connected to another portion of the bottom surface of the airflow chamber that faces the upper wall of the airflow chamber and configured to create negative pressure in the second space, the other portion of the bottom surface forming the second space.

8. The inkjet recording apparatus according to claim 7, wherein the negative pressure applying section further includes a first gas outlet, a second gas outlet, and a collection member disposed at the first gas outlet, the first negative pressure creating section creates negative pressure in the first space by discharging air outward of the first space through the first gas outlet, the second negative pressure creating section creates negative pressure in the second space by discharging air outward of the second space through the second gas outlet, and the collection member collects paper dust mixed with air that is to be discharged outward of the first space.

9. The inkjet recording apparatus according to claim 7, wherein an amount of air discharged by the first negative pressure creating section per unit time is greater than an amount of air discharged by the second negative pressure creating section per unit time.

10. The inkjet recording apparatus according to claim 1, wherein the gap forming section is disposed to form the narrow gap such that the distance across the narrow gap in the direction perpendicular to the conveying surface is equal to or shorter than a threshold distance that is set in advance.

11. The inkjet recording apparatus according to claim 1, wherein the gap forming section includes a plate member disposed opposite to the conveying surface of the conveyance section and having a flat surface substantially parallel to the conveying surface of the conveyance section.

12. The inkjet recording apparatus according to claim 11, wherein the plate member is an electrical conductor that is grounded.

13. The inkjet recording apparatus according to claim 11 further comprising a head base configured to support the recording head, wherein the plate member is secured to the head base, and the head base has a hole located upstream of the plate member in the conveyance direction of the recording medium and another hole located downstream of the plate member in the conveyance direction of the recording medium that allow air to flow into the narrow gap.

14. The inkjet recording apparatus according to claim 11, wherein the plate member includes a tapered portion such that the distance across the narrow gap in the direction perpendicular to the conveying surface is greater toward an edge of the plate member in the conveyance direction of the recording medium.

* * * * *